US005609723A

United States Patent [19]

Solinas et al.

[11] Patent Number: 5,609,723

[45] Date of Patent: Mar. 11, 1997

[54] OXYGEN BLEACHING PROCESS FOR CELLULOCIS PULPS WITH A POLYHYDRIC ALCOHOL CELLULOSE PROTECTOR

[75] Inventors: Marco Solinas, Vancouver; Allan M. Proust, Surrey, both of Canada

[73] Assignee: MacMillan Bloedel Limited, Vancouver, Canada

[21] Appl. No.: 489,075

[22] Filed: Jun. 9, 1995

Related U.S. Application Data

[63] Continuation of Ser. No. 234,028, Apr. 28, 1994, abandoned.

[51] Int. Cl.[6] ..... D21C 9/147

[52] U.S. Cl. ..... 162/65; 162/72; 162/77

[58] Field of Search ..... 162/57, 65, 77, 162/82, 90, 72

[56] References Cited

U.S. PATENT DOCUMENTS

| | | | |
|---|---|---|---|
| 3,652,386 | 3/1972 | Noreus et al. | 162/65 |
| 4,004,967 | 1/1977 | Swan et al. | 162/65 |
| 4,622,100 | 11/1986 | Godsay et al. | 162/65 |

FOREIGN PATENT DOCUMENTS

| | | |
|---|---|---|
| 5051889 | 3/1993 | Japan . |
| 5186987 | 7/1993 | Japan . |
| 5279979 | 10/1993 | Japan . |

*Primary Examiner*—Steven Alvo
*Attorney, Agent, or Firm*—C. A. Rowley

[57] ABSTRACT

An improved oxygen bleaching process wherein the pulp is bleached in an aqueous organic medium wherein a polyhydric alcohol constitutes between 10 and 70% by weight of the medium to produce a pulp having a viscosity at least 2.5 cp higher than a similar pulp bleached using the same conditions in an aqueous atmosphere to the same kappa no. of 8 ml.

18 Claims, 4 Drawing Sheets

OXYGEN BLEACHING PROCESS FOR CELLULOCIS PULPS WITH A POLYHYDRIC ALCOHOL CELLULOSE PROTECTOR

This application is a continuation of Ser. No. 08/234,028, filed Apr. 28, 1994 and now abandoned.

FIELD OF THE INVENTION

The present invention relates to oxygen bleaching of cellulose pulp, more particularly, the present invention relates to the bleaching of cellulosic pulp with oxygen in an aqueous organic medium.

BACKGROUND OF THE PRESENT INVENTION

Oxygen bleaching of wood pulp, for example, is used as an extension to the kraft process to reduce the kappa no. and increase the brightness of the pulp and is generally followed by other bleaching stages such as peroxide and/or chlorine dioxide, ozone or the like. Oxygen bleaching is a cost efficient method of delignification because it uses very inexpensive chemicals. Thus, the lower one can reduce the lignin content of the pulp in an oxygen stage, the lower the bleaching costs can be, provided the characteristics of the resultant pulp meet the requirements of the customer.

In practice, oxygen is used only to a limited degree because of its lack of selectivity with respect to cellulose and the fact that it significantly lowers the viscosity of the pulp when used to produce a pulp with a low kappa number, i.e. approximately a kappa no. of 8 ml. The industry's response has been to extend pulping to lower kappa numbers by way of modified kraft pulping schemes and to limit the role of oxygen bleaching to remove only a modest amount of lignin.

Use of organic additives in the aqueous medium surrounding the pulp during the oxygen bleaching stage is known. Attention is directed to Japanese patent application 50-51889 published Mar. 2, 1993, issued to Mitsubishi Paper Mills Ltd., which discloses the use of minor amounts of nonionic surfactant and a derivative of ethylene diamine tetra acetic acid in an oxygen bleaching stage which the patentee claims, permits obtaining a lower kappa number pulp compared with the conventional medium concentration oxygen bleaching method.

Japanese patent 51-86987 published Jul. 27, 1993, issued to Sanyo Chemical Industries Ltd., teaches bleaching of the cellulose pulp with oxygen or peroxide in the presence of an ether compound, a polyol and an aliphatic monohydric alcohol. The ether compound may be derived from a polyhydric alcohol or its alkylene oxide adduct, preferably ethylene glycol. The amount of organic additive used is quite small and the effects obtained do not appear to be particularly significant, i.e. the viscosity obtained is very similar to the control at about the same kappa number.

Japanese patent 52-79979 published Oct. 26, 1993, issued to Mitsubishi Paper Mills Ltd., describes a bleached pulp obtained by bleaching with oxygen and a nonionic surfactants of polyether type compounds and may or may not include organic metal salt and glycol. The pulp produced is claimed to have the advantage of easier washing.

BRIEF DESCRIPTION OF THE PRESENT INVENTION

It is the main object of the present invention to provide a new method of oxygen bleaching of cellulosic pulps in an aqueous organic medium to produce a bleached pulp of higher viscosity for a given kappa number as compared with a conventionally oxygen bleached pulp.

Broadly the present invention relates to an improved oxygen bleaching process for bleaching cellulosic pulp comprising mixing said pulp with caustic to uniformly distribute the caustic throughout the pulp in an amount to obtain the desired reduction in kappa no. of the pulp during an oxygen bleaching stage, surrounding the pulp with an aqueous medium containing between 10% and 70% by weight of a polyhydric alcohol in said oxygen bleaching stage, bleaching said pulp with oxygen in said oxygen bleaching stage and under an oxygen pressure to obtain oxygen bleaching and produce an oxygen bleached pulp having the equivalent of at least 2.5 cp higher viscosity than a similar softwood pulp bleached to the same kappa no. of 8 ml using the same conditions but in water substantially free of additives.

Preferably, said polyhydric alcohol will be at a concentration of between 30% and 60% based on the weight of said aqueous medium.

Preferably, the polyhydric alcohol will be selected from a group consisting of ethylene glycol, propylene glycol, glycerol and pentaerythrytol and diethyleneglycol.

Preferably, the bleaching liquor will contain magnesium sulfate in the range of 0.50% to 2.0% based on the weight of the pulp.

Preferably, the temperature will be in the range of 60° C. to 90° C. in the oxygen bleaching stage.

Preferably, said pulp will be at a consistency of between 3% and 50% more preferably, between 20% and 45%.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
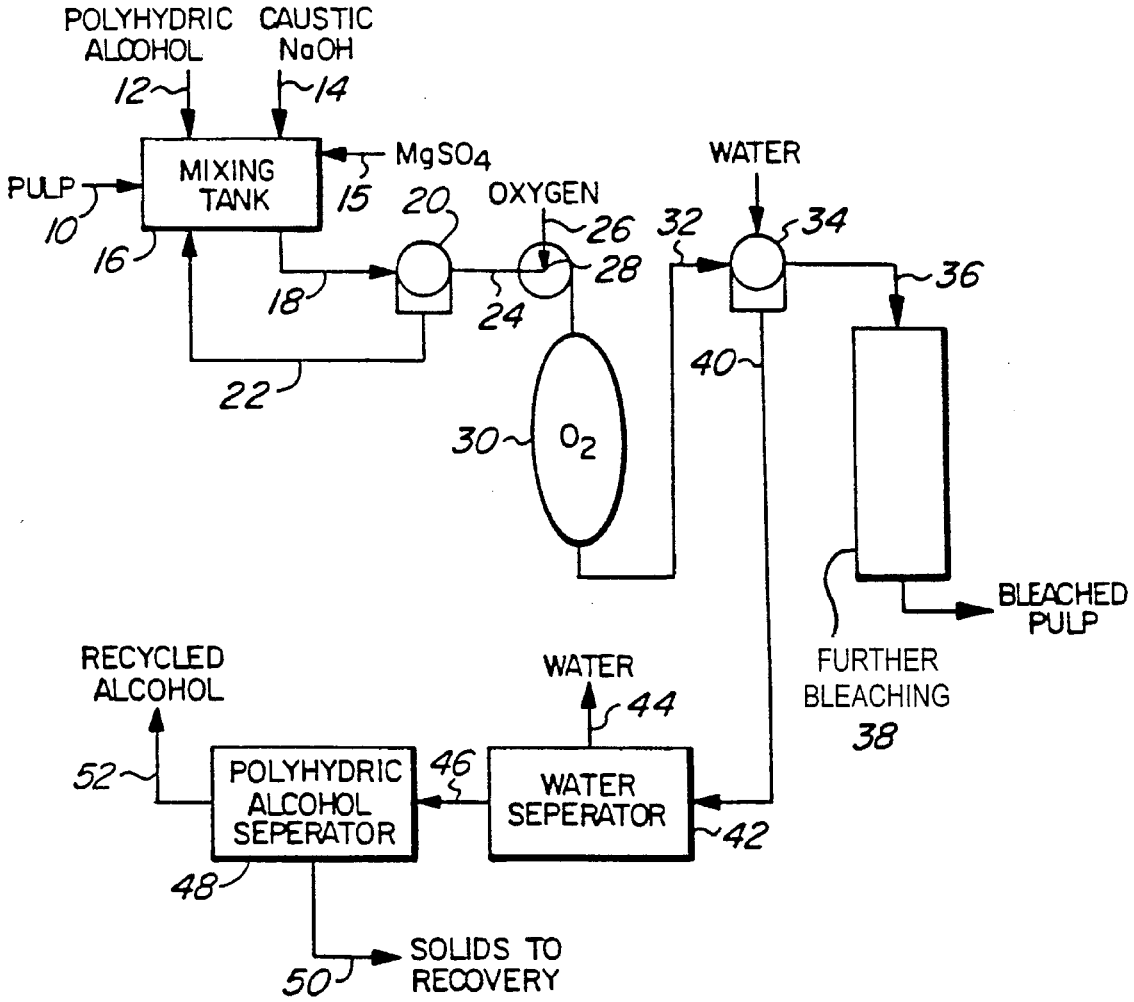
FIG. 1 is a schematic illustration of a bleaching process incorporating the present invention.

As illustrated in FIG. 1, the process of the present invention introduces pulp as indicated by a line 10 (pulp in line 10 will normally be a consistency of about 30%) and applies a polyhydric alcohol as indicated via line 12 and caustic as illustrated by a line 14 (magnesium sulfate ($MgSO_4$) may also be added as indicated by a line 15) to the pulp in a suitable vessel 16. The pulp in an aqueous medium containing the appropriate amount of caustic to obtain the desired delignification and of polyhydric alcohol to protect the pulp is pumped at low consistency (say 3%) from vessel 16 via line 18 to a thickener 20 where the excess medium is removed and the consistency raised to that to be used in the oxygen bleaching reactor 30 (O stage). The medium removed in the thickener 20 is returned to the vessel 16 via a line 22.

The aqueous medium in which the pulp is bleached in the oxygen bleaching stage 30 contains an amount of polyhydric alcohol in the range of 10% to 70% by weight of the aqueous medium. The best results are obtained when the aqueous medium contains between 30% and 60%.

The pulp at the required consistency in the aqueous medium, which depends on the type of oxygen stage 30 to be used, i.e. high, low or medium consistency (i.e. a consistency of between 3% and 50%), is carried in the line 24 to the oxygen stage 30. Preferably the oxygen stage will be operated at high consistency in the range of 20% to 45%.

The pulp is mixed with oxygen introduced as indicated by the line 26 and mixed by the pump or other mixer 28 with the pulp and then passed into a vessel 30 forming the oxygen bleaching stage (O stage) wherein oxygen bleaching is carried out. All the oxygen may be directly added to the vessel in which the O stage 30 is to be carried out rather than at least part being premixed with the in-coming pulp at 28.

Generally the O stage will be at an oxygen pressure above atmospheric in the range required to obtain oxygen delignification, i.e. above about 50 psig.

The temperature in the O stage may be the normal temperature used in a conventional O stage namely between about 100° C. and 125° C. When higher strength pulps are desired it is preferred to lower the operating temperature to below 100° C. preferably below 90° C. for example to be within the range of 60° C. to 90° C. more specifically within the range of 60° C. to 80° C. and to increase the retention time to attain the desired delignification (the other parameters need not be changed). Increasing the retention time simply requires a larger vessel. Operating at 80° C. using a polyhydric alcohol containing medium, a bleached pulp having a viscosity of 21 cp verses a viscosity of 12.5 cp for the control at the same kappa no. of 6 ml could be produced.

The pulp is held in the O stage 30 for a suitable period of time which will normally be at least 30 minutes (at least twice as long when operating at temperatures below 100° C.) and then is removed as indicated by line 32.

The polyhydric alcohol is then removed from the pulp preferably by washing as indicated at 34 and the washed pulp is then carried as indicated by line 36 to further bleaching stages 38.

The filtrate from washer 34 is delivered via line 40 to an alcohol recovery system wherein preferably, the alcohol and water are separated in a first stage 42 wherein water is evaporated as indicated at 44. The polyhydric alcohol and precipitated materials are delivered via line 46 to a second stage 48 wherein the precipitated materials are then separated from the alcohol and preferably returned to the recovery system for incineration as indicated by line 50 and the polyhydric alcohol recirculated to the system as indicated by line 52.

The polyhydric alcohols used will preferably be selected from the group consisting of ethylene glycol, diethylene glycol, propylene glycol, glycerol and pentaerythrytol. However, it is believed that other suitable polyhydric alcohols will probably also operate although they are more expensive.

Is it preferred to use ethylene glycol and to use it (and the other polyhydric alcohols) within the range of about 25% to 35% ethylene glycol (polyhydric alcohol) in the aqueous bleaching medium.

It has been found that the addition of magnesium sulfate to the aqueous medium as indicated by line 15 so that the aqueous medium in the bleaching process contains between about 0.50% to 2.0% by weight of magnesium sulfate based on the dry weight of the pulp (preferably about 1%) improves the viscosity of the pulp at a given kappa number. This improvement is noted whether the bleaching medium is an aqueous medium substantially free of alcohol or if contains any one of the polyhydric alcohols referred to above. The use of the magnesium sulfate improves the viscosity of the pulp measured at a kappa no. of about 8 ml by between 1 cp and about 2 cp.

EXAMPLES

Western hemlock kraft pulp having a kappa no. of 27.4 ml and a viscosity of 28.1 cp was used in all the tests. All the tests were carried out on pulp at a consistency of 25% a temperature of 105° C., a pressure of 100 psi, for a period of 45 minutes in the O stage except for the lower temperature tests shown in FIG. 6 which were carried out at a temperature of 80° C. for 185 minutes.

The incoming pulp was mixed with sodium hydroxide at a low consistency, i.e. 3% and thickened to the bleaching consistency 25% before being introduced into the bleaching vessel. In each of the experiments, the sodium hydroxide was present in the amount of 0.5% to 0.8% based on the dry weight of the pulp.

Where $MgSO_4$ was used on the pulp, it was present in the amount of 1% based on the weight of the pulp fibers.

The control runs were produced using water (no alcohol) as the bleaching medium and the other runs using a mixture of the various polyhydric alcohols and water as the aqueous medium.

The results are presented in FIGS. 2 to 6 inclusive.

Figure 2:
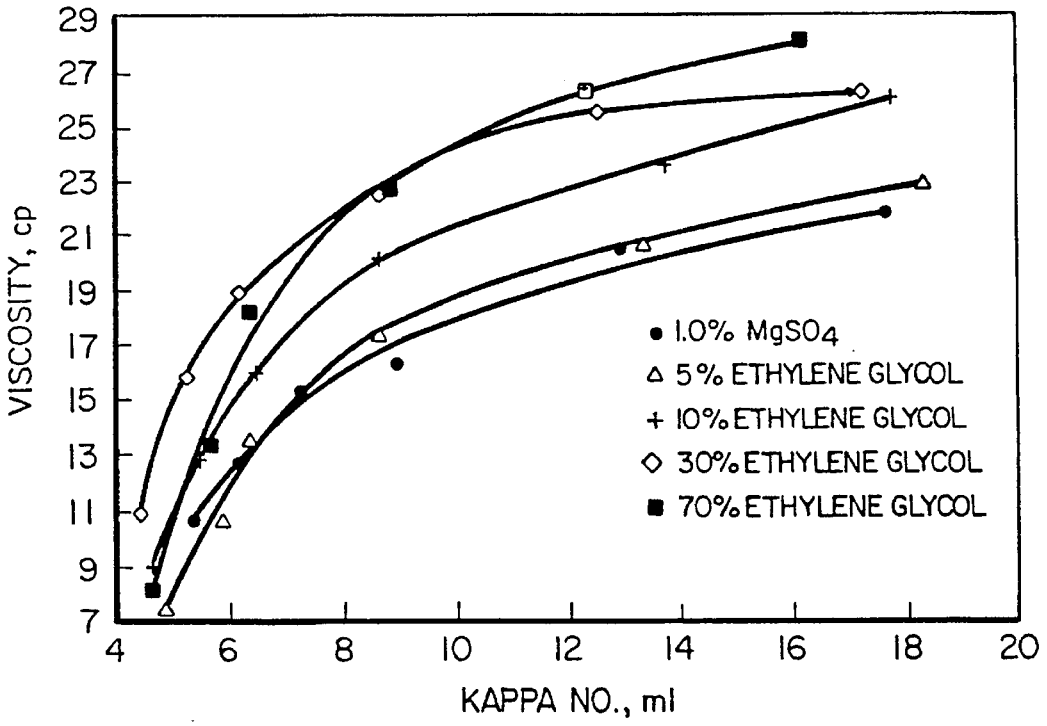
FIG. 2 is a plot of viscosity versus kappa number showing the effects of various percentages of ethylene glycol in bleaching medium.

The plots in FIG. 2 of viscosity versus kappa number are for an oxygen bleached control pulp bleached in an aqueous medium containing only magnesium sulfate (1%) and for pulps oxygen bleached in an aqueous medium containing different amounts of ethylene glycol solution no magnesium sulfate was present.

It can be seen that with the concentration of 5% glycol in the aqueous medium no effect is seen. However, when the glycol concentration is 10%, about a 2.5 cp increase in viscosity is obtained at a kappa no. of 8 ml, and when the amount of ethylene glycol was increased to 30%, the improvement in viscosity at the given kappa no. of 8 ml is in the order of about 7 cp.

It will also be noted that when the percentage of ethylene glycol is increased to 70%, very little, if any, further improvement (at a kappa no. of 8 ml) over what was obtained at 30% ethylene glycol is obtained and in fact, at lower kappa numbers (below 8 ml), there was a disadvantage of using the higher percentage of ethylene glycol.

Figure 3:
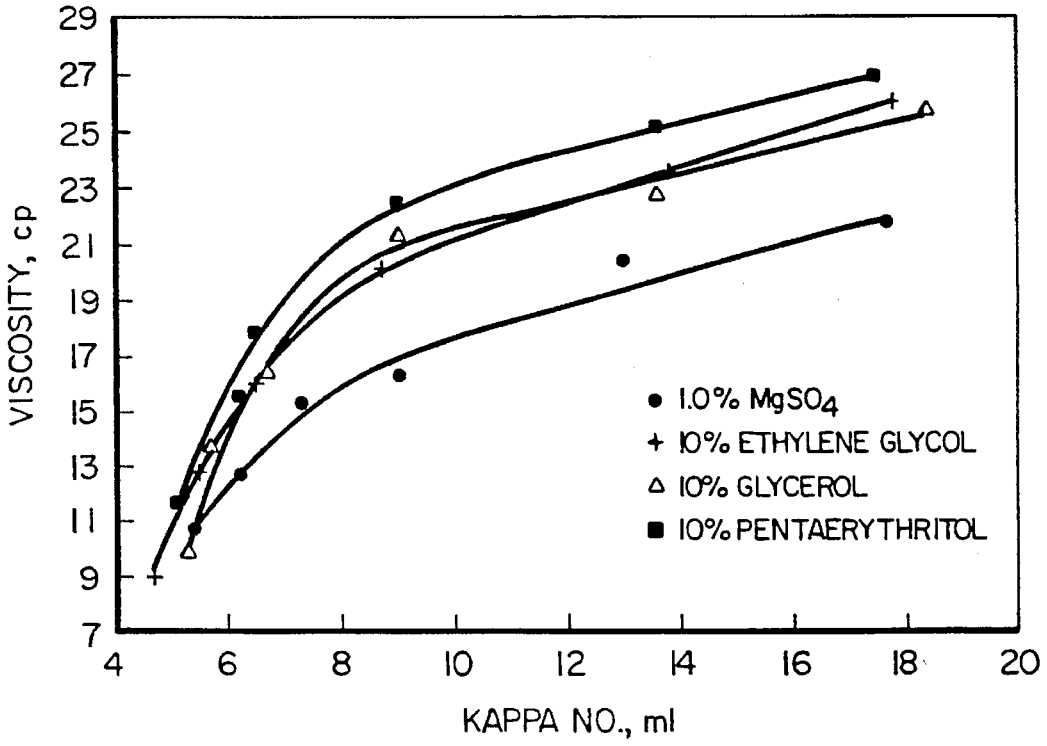
FIG. 3 is a plot of viscosity versus kappa number for different polyhydric alcohols in the aqueous medium.

FIG. 3 also is a plot of viscosity versus kappa number but for (control) pulps oxygen bleached in aqueous mediums containing no polyhydric alcohols but containing magnesium sulfate (1% concentration) and in aqueous mediums containing three different polyhydric alcohols (no magnesium sulfate) at relatively low concentrations of 10%. It can be seen that the viscosity of the oxygen bleached pulp is significantly higher (relative to the control) when the polyhydric alcohols are used, namely a viscosity increase at a kappa no. of 8 ml of 3.4 cp when ethylene glycol or glycerol are used and 5.4 cp when pentaerythritol is used.

To determine the effect of the use of 1% magnesium sulfate in the medium together with polyhydric alcohols tests were conducted using 10% ethylene glycol with and without magnesium sulfate in the medium and compared with the same tests with water containing no alcohol but with magnesium sulfate present (the control) and it was found that the use of ethylene glycol improved the viscosity of the bleached pulp at a kappa no. of 8 ml by over 3 cp relative to the control and that when the ethylene glycol containing medium also included magnesium sulfate a further gain in viscosity of over 1 cp was obtained, thereby indicating that the addition of magnesium sulfate to mediums containing polyhydric alcohols improved the viscosity by about the same amount as when the medium was water (no alcohol).

Figure 4:
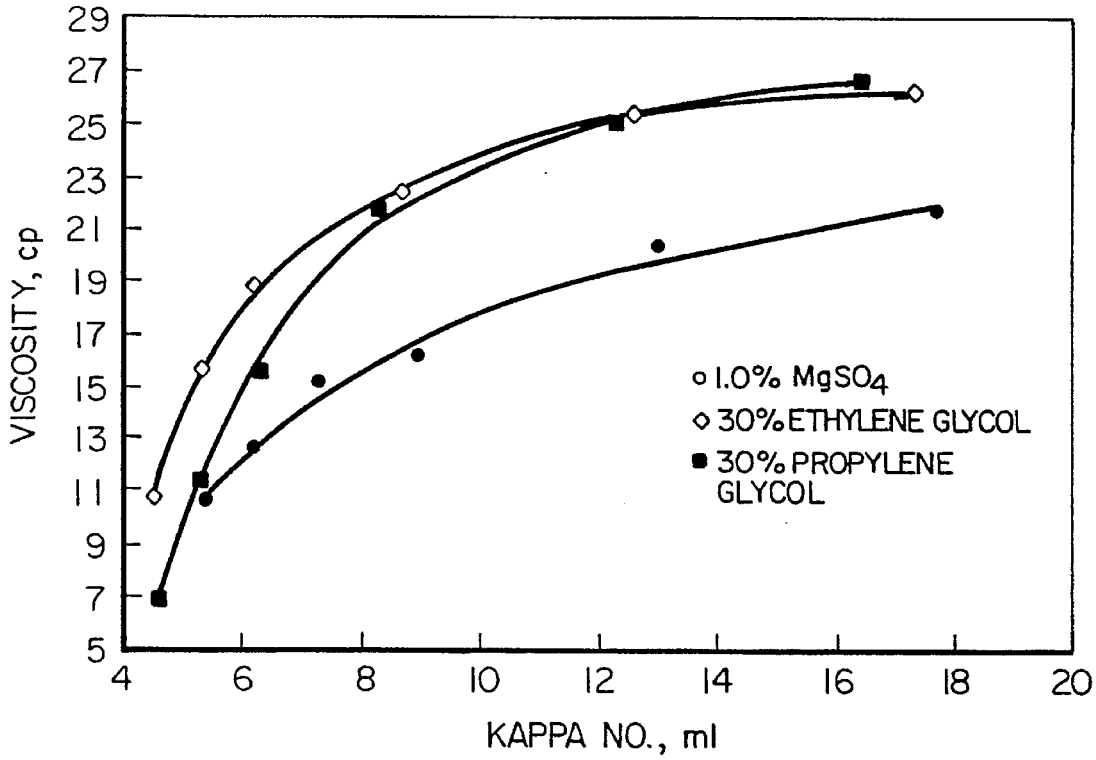
FIG. 4 compares the results obtained using 30% ethylene glycol in the aqueous medium with those obtained using 30% propylene glycol.

FIG. 4 compares ethylene glycol with propylene glycol at 30% concentration and indicates that the two glycols had a similar effect on pulp viscosity at a kappa no. of about 8 ml and higher and that ethylene glycol seems to be more effective when the delignification is carried further.

Figure 5:
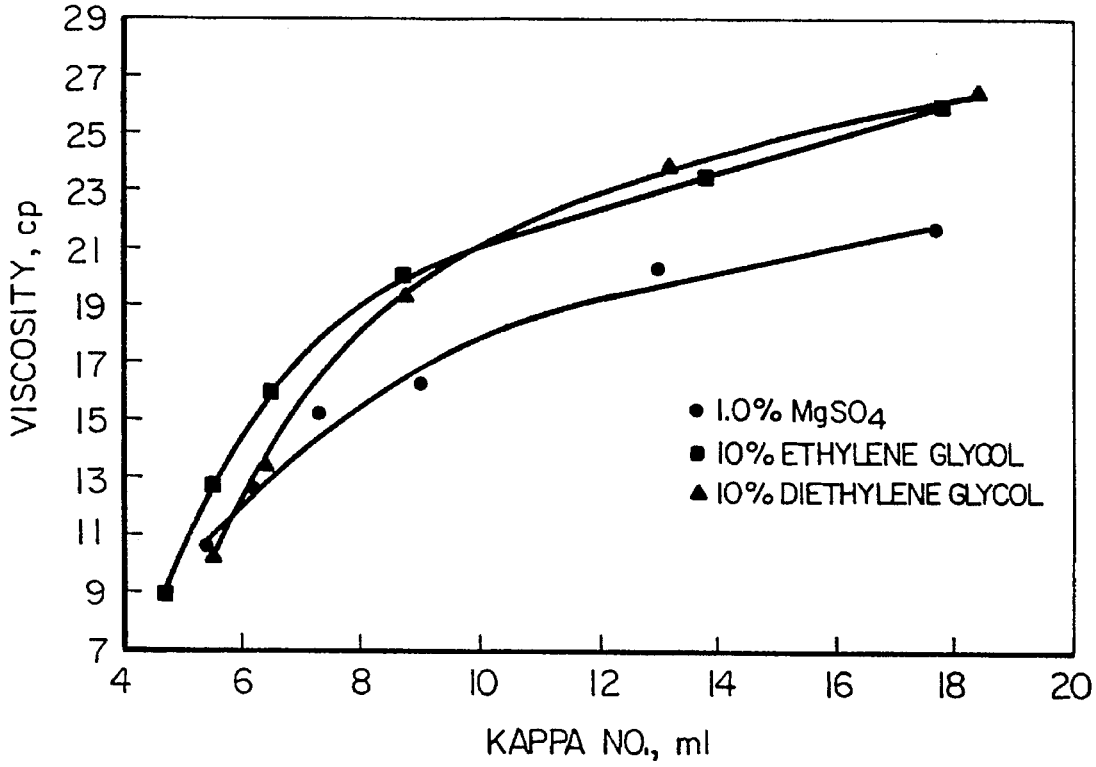
FIG. 5 is a comparison of viscosity of the pulps at different kappa numbers obtained using ethylene glycol and dietyhlene glycol at a concentration of 10% in the medium.

FIG. 5 shows the effect of diethylene glycol at 10% concentration compared with ethylene glycol at the same concentration. Again, the diethylene glycol and ethylene glycol are very similar down to a kappa no. of about 8 ml but at kappa numbers below 8 ml, the ethylene glycol is seen to be superior.

For some reason, use of ethylene glycol when bleaching to kappa numbers below about 8 ml, provides unexpected and improved results over any of the other polyhydric alcohols tested.

Experiments were carried out using temperatures in the O stage well below the temperatures normally used in conventional O stage bleaching. The results for operation using 30% ethylene glycol in the aqueous medium at normal temperature (105° C.) and time (45 minutes) are compared with O stage bleaching using the same medium, but at 80° C. and a residence time of 185 minutes, in FIG. 6. It is apparent that by lowering the temperature and increasing the residence time in the O stage the resultant pulp was significantly better than that obtained using the conventional temperature and residence time.

Figure 6:
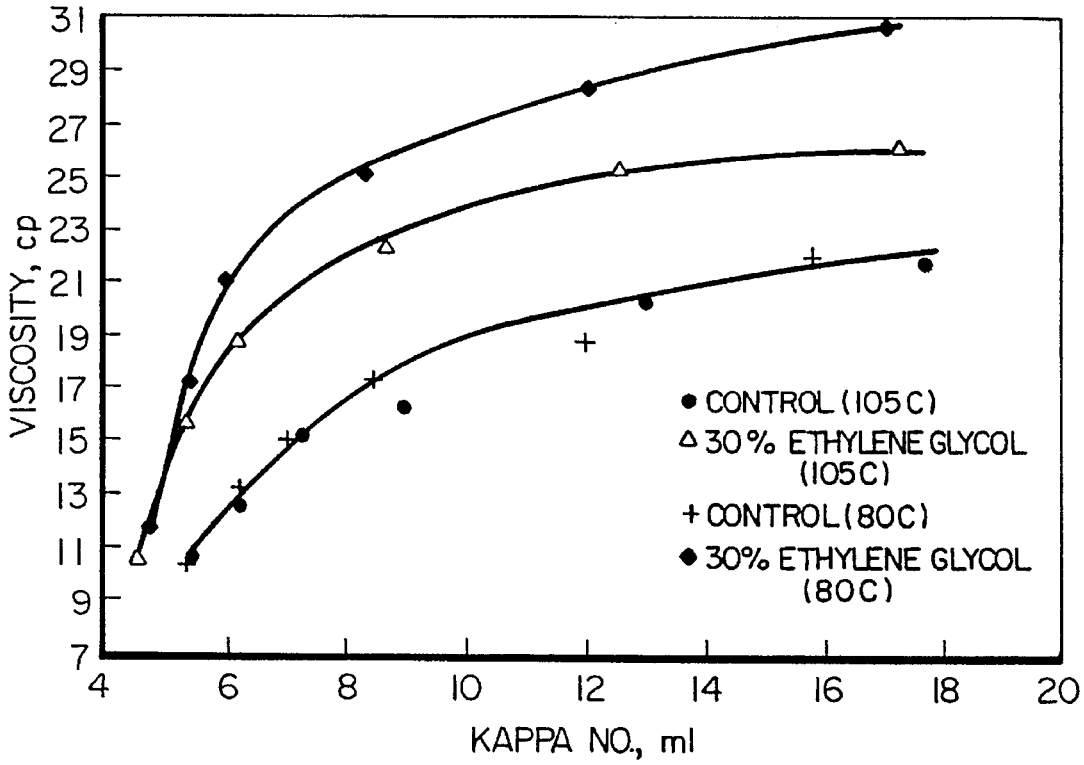
FIG. 6 shows a comparison of viscosity versus kappa number for pulps produced using the same polyhydric alcohol in the aqueous medium one operating at conventional operating temperatures for oxygen bleaching and the other at lower temperature.

As also can be seen from FIG. 6, the effect of reduced temperature, i.e. 80° C. from 105° C. when water as the medium, is negligible, i.e. there is no effect in decreasing the temperature. Thus, the above noted effect when ethylene glycol is used as the medium, and the temperature is reduced from 105° C. to 80° C. provides a further unexpected advantage for the invention.

The above findings indicate that the use of polyhydric alcohols in the medium surrounding the pulp during oxygen bleaching provides an alternative to ozone for a totally chlorine-free bleaching process, for example, by bleaching the conventional brown stock or brown stock obtained by modified pulping such as extended delignification with oxygen according to the present invention and reducing the kappa no. to 6 or 7 ml followed by bleaching with a suitable chlorine-free sequence such as peroxide.

If a totally effluent free process is being considered, it may be less expensive to use the modified oxygen stage of the present invention and complete the bleaching using small amounts of chlorine dioxide whose effluent would be removed from the pulp and sent to the recovery system of the mill.

Having described the invention, modifications will be evident to those skilled in the art without departing from the scope of the invention as defined in the appended claims.

We claim:

1. An improved oxygen bleaching process for bleaching cellulosic pulp comprising mixing said pulp with an aqueous medium containing a polyhydric alcohol cellulose protector and caustic to uniformly distribute the caustic and protector throughout the pulp to form a treated pulp, said polyhydric alcohol being selected from the group consisting of ethylene glycol, propylene glycol, glycerol, pentaerythrytol and diethylene glycol, passing said treated pulp in said aqueous medium into said oxygen bleaching stage, said aqueous medium in said oxygen bleaching stage containing between 10% and 70% by weight of said polyhydric alcohol and sufficient of said caustic to obtain the desired reduction in kappa no. during said oxygen bleaching stage, bleaching said pulp with oxygen in said oxygen bleaching stage in an oxygen atmosphere in said aqueous medium containing said caustic and between 10% and 70% by weight of said polyhydric alcohol at a pressure to obtain oxygen bleaching and produce an oxygen bleached pulp having a higher viscosity than a similar softwood pulp oxygen bleached to the same kappa no. using the same conditions but in water substantially free of cellulose protectors.

2. A process as defined in claim 1 wherein said polyhydric alcohol will comprise between 30% and 60% based on the weight of said aqueous medium in said oxygen bleaching stage.

3. A process as defined in claim 2 wherein said polyhydric alcohol is ethylene glycol.

4. A process as defined in claim 3 wherein said aqueous medium in said oxygen bleaching stage also contains magnesium sulfate in the range of 0.5% to 2.0% based on the weight of the pulp.

5. A process as defined in claim 4 wherein said pulp is at a consistency of between 20% and 45% during bleaching in said oxygen bleaching stage.

6. A process as defined in claim 3 wherein the temperature in said oxygen bleaching stage is in the range of 60° C. to 90° C.

7. A process as defined in claim 6 wherein said pulp is at a consistency of between 20% and 45% during bleaching in said oxygen bleaching stage.

8. A process as defined in claim 3 wherein said pulp is at a consistency of between 20% and 45% during bleaching in said oxygen bleaching stage.

9. A process as defined in claim 2 wherein said aqueous medium in said oxygen bleaching stage also contains magnesium sulfate in the range of 0.5% to 2.0% based on the weight of the pulp.

10. A process as defined in claim 9 wherein said pulp is at a consistency of between 20% and 45% during bleaching in said oxygen bleaching stage.

11. A process as defined in claim 2 wherein the temperature in said oxygen bleaching stage is in the range of 60° C. to 90° C.

12. A process as defined in claim 11 wherein said pulp is at a consistency of between 20% and 45% during bleaching in said oxygen bleaching stage.

13. A process as defined in claim 2 wherein said pulp is at a consistency of between 20% and 45% during bleaching in said oxygen bleaching stage.

14. A process as defined in claim 1 wherein said aqueous medium in said oxygen bleaching stage also contains magnesium sulfate in the range of 0.5% to 2.0% based on the weight of the pulp.

15. A process as defined in claim 14 wherein said pulp is at a consistency of between 20% and 45% during bleaching in said oxygen bleaching stage.

16. A process as defined in claim 1 wherein the temperature in said oxygen bleaching stage is in the range of 60° C. to 90° C.

17. A process as defined in claim 16 wherein said pulp is at a consistency of between 20% and 45% during bleaching in said oxygen bleaching stage.

18. A process as defined in claim 1 wherein said pulp is at a consistency of between 20% and 45% during bleaching in said oxygen bleaching stage.

* * * * *